US008796957B2

(12) United States Patent
Shin et al.

(10) Patent No.: US 8,796,957 B2
(45) Date of Patent: Aug. 5, 2014

(54) MULTI-STRING LED DRIVING METHOD AND SYSTEM

(75) Inventors: Hyunick Shin, Seoul (KR); Insoo Yoo, Gihung-gu (KR)

(73) Assignee: Analog Devices, Inc., Norwood, MA (US)

( * ) Notice: Subject to any disclaimer, the term of this patent is extended or adjusted under 35 U.S.C. 154(b) by 316 days.

(21) Appl. No.: 13/249,025

(22) Filed: Sep. 29, 2011

(65) Prior Publication Data

US 2013/0082613 A1 Apr. 4, 2013

(51) Int. Cl.
*H05B 37/00* (2006.01)

(52) U.S. Cl.
USPC ..... 315/323; 315/224; 315/247; 315/312; 315/185 S

(58) Field of Classification Search
USPC ..... 315/247, 224, 291, 307–326, 185 S, 315/276–279
See application file for complete search history.

(56) References Cited

U.S. PATENT DOCUMENTS

| | | | | |
|---|---|---|---|---|
| 8,400,073 | B2 * | 3/2013 | Byun et al. | 315/291 |
| 8,427,081 | B2 * | 4/2013 | Hsu et al. | 315/360 |
| 2007/0195025 | A1 | 8/2007 | Korcharz et al. | 345/82 |
| 2008/0100234 | A1 * | 5/2008 | Chen et al. | 315/312 |
| 2008/0106216 | A1 * | 5/2008 | Yu et al. | 315/247 |
| 2011/0156600 | A1 | 6/2011 | Santo et al. | 315/185 R |
| 2013/0093343 | A1 * | 4/2013 | Briggs | 315/210 |

OTHER PUBLICATIONS

PCT Notification of the International Search Report and the Written Opinion of the International Searching Authority, Dated Nov. 23, 2012: for International Application No. PCT/US2012/050008.
Intersil, "6-Channel LED Driver With Phase Shift Control and Frame Rate to Dimming Frequency Synchronization", ISL97674, pp. 1-28, Jun. 25, 2010.

* cited by examiner

*Primary Examiner* — Tuyet Thi Vo
(74) *Attorney, Agent, or Firm* — Schwegman Lundberg & Woessner, P.A.

(57) ABSTRACT

A multi-string LED driving method and system requires generating pulse-width-modulated (PWM'd) driving signals to respective LED strings to control their brightness levels, and staggering the timing of the driving signals such that the number of LED strings driven on simultaneously varies over time by no more than one LED string. The PWM'd driving signals are generated to, for example, achieve local dimming for a display device which employs a multi-string LED backlight system; the present method enables local dimming to be achieved while maintaining a relatively constant load on the drive circuit. The staggering of the timing of the PWM'd driving signals is preferably implemented by arranging the ON times of the driving signals such that they occur serially, such that the loading imposed by the LED strings is spread throughout each switching cycle.

11 Claims, 4 Drawing Sheets

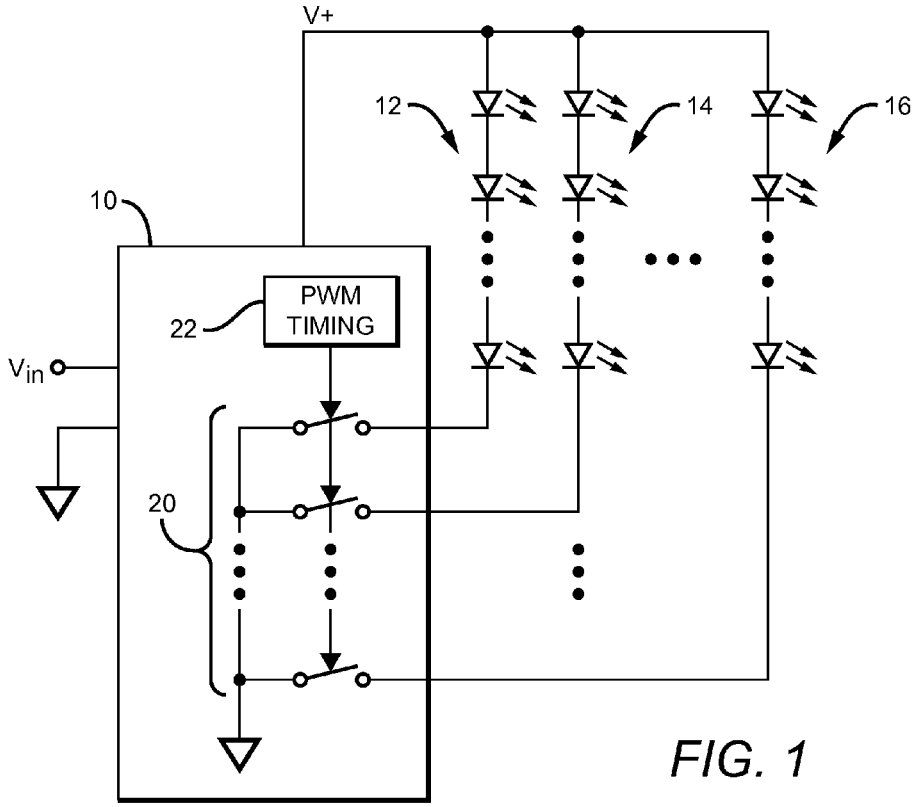
FIG. 1
FIG. 2
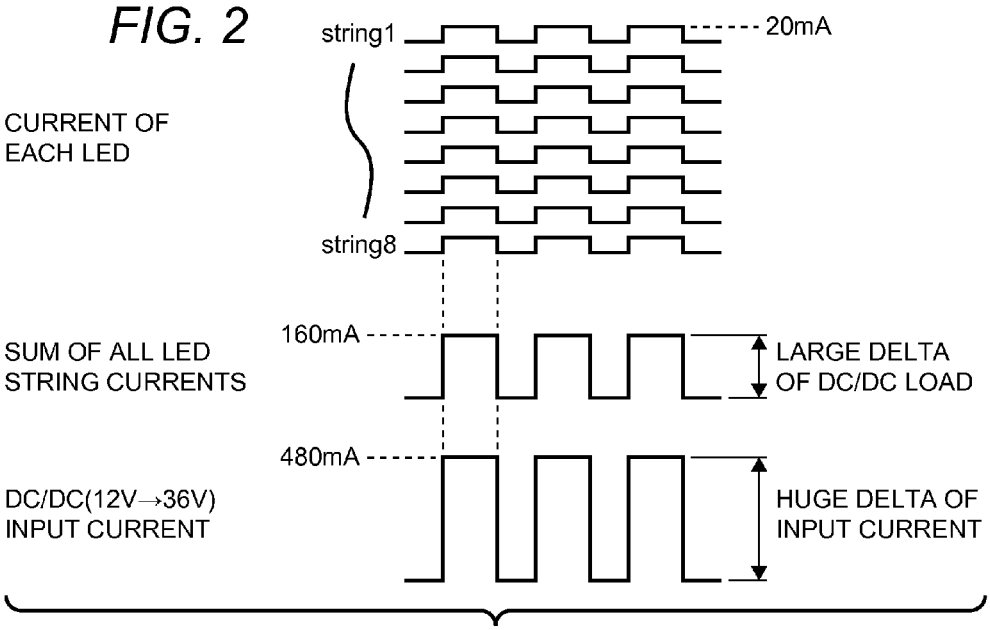

FIG. 3
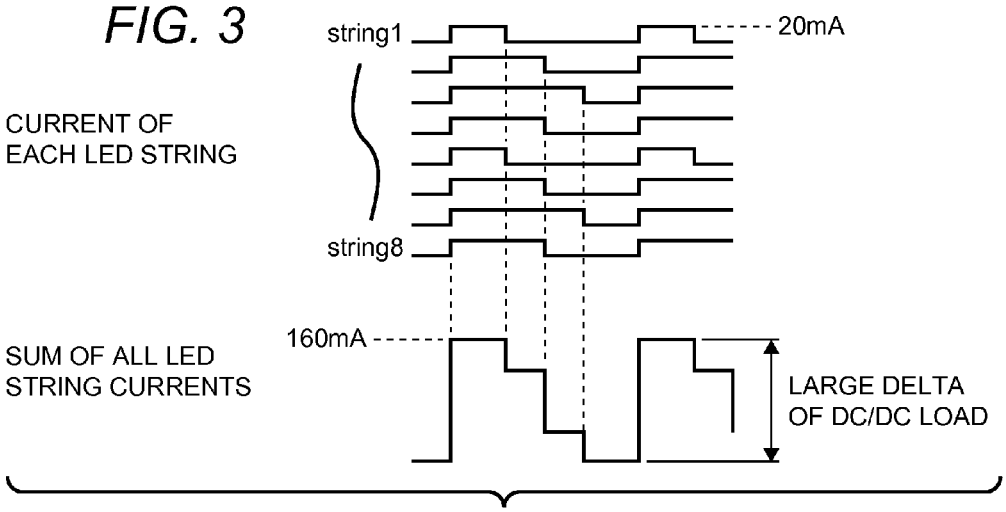
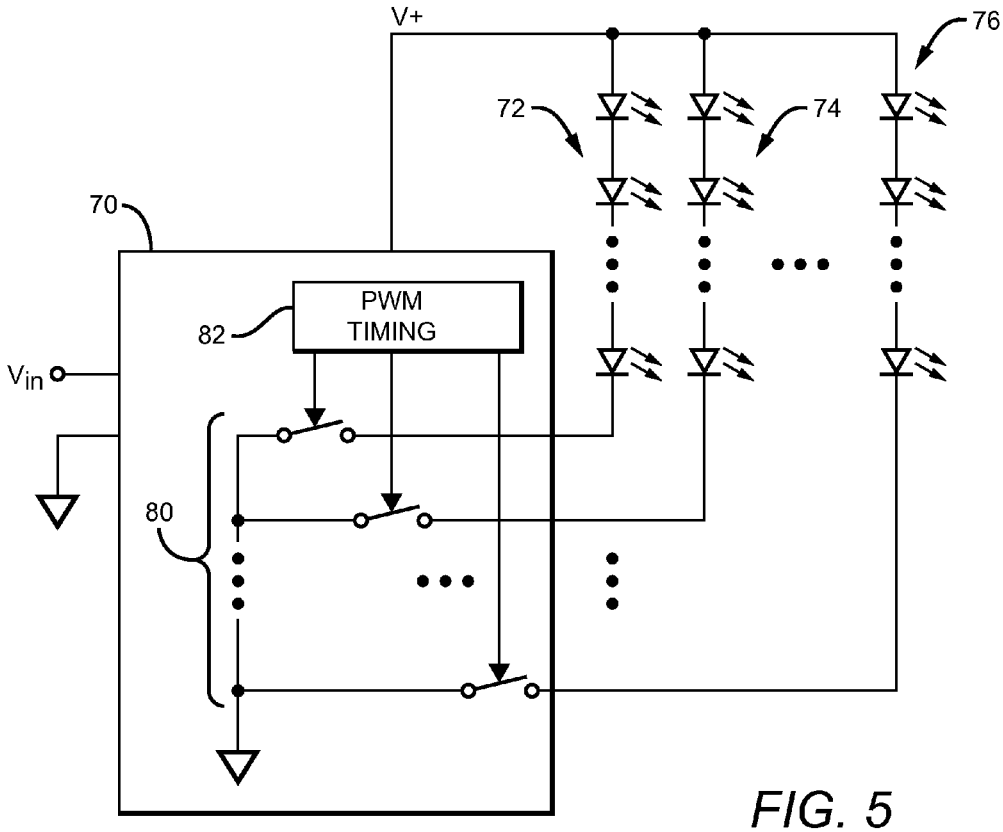
FIG. 5

MULTI-STRING LED DRIVING METHOD AND SYSTEM

BACKGROUND OF THE INVENTION

1. Field of the Invention

This invention relates generally to systems for driving strings of LEDs, and more particularly to methods of facilitating 'local dimming' in a display device made from LED strings.

2. Description of the Related Art

Light-emitting diodes (LEDs) are becoming increasingly popular as a light source. In some applications, such as providing a source of backlight for a display device, many LEDs are used. The LEDs are typically connected in series, cathode-to-anode, to form an LED 'string', with all of the LEDs in the string driven on by applying a voltage between the first anode and the last cathode in the string. Since having a large number of LEDs in a string would necessitate a corresponding large driving voltage, the LEDs are typically arranged into a number of smaller strings, each of which can be driven on with a lower driving voltage.

A simplified illustration of such a system is shown in FIG. 1. Here, an LED drive circuit 10 interfaces with a number of LED strings 12, 14, 16, each of which includes multiple LEDs connected in series. Drive circuit 10 also controls a number of switching elements 20 which are connected to the cathode ends of respective strings, and provides a driving voltage V+ which is applied to the anode end of each string. In this example, a timing circuit 22 within LED drive circuit 10 operates the switching elements 20 in unison to pulse-width modulate (PWM) the currents conducted by the LED strings to which they are connected; the duty cycle of the PWM signals determines the brightness of the LEDs in the strings. The DC voltage provided to the LED strings may be provided by, for example, a switching power converter (not shown)—most typically a boost-type power converter (referred to herein as a 'boost converter', which produces an output referred to herein as a 'boost voltage')—or a charge pump boost circuit.

This brightness control method can have several drawbacks. Assume, for example, that there are 8 LED strings, each of which conducts 20 ma of current when on. Thus, when all 8 strings are driven on, the total current load jumps from 0 ma to about 160 ma. A timing diagram illustrating the individual and summed pulse-width modulated (PWM'd) currents for the 8 strings is shown in FIG. 2.

If the LED drive circuit includes a DC/DC boost converter which receives a DC input voltage $V_{in}$ of 12V and produces a DC output voltage V+ of 36V, the average value of the summed inductor currents (i.e., the converter's input current) will be about (160 ma×3=) 480 mA when the LEDs are on. Thus, the input current suffers from large fluctuations due to the periodic and simultaneous on/off operation of the LED strings. In battery-operated system such as a laptop, $V_{in}$ may decrease over time to, for example, 6V, and the input current change will be increased accordingly.

One approach that has been taken to reduce the magnitude of load fluctations of this sort is to phase shift the PWM'd currents so that they are evenly spaced throughout the switching cycle. This technique may be effective at making the total current load nearly constant, but requires that the ON times for each LED string be identical, which may be unacceptably limiting.

Some display devices employ a technique known as 'local dimming', in which the display's screen area is divided into a number of areas, with the brightness of the backlight behind each area being independently controllable. This can provide a higher contrast ratio for the screen, as well as lower its power consumption. To provide this functionality, the individual LED strings need to be independently controllable. However, this technique can cause a complicated load condition to be presented to the LED drive circuit. This situation is illustrated in FIG. 3. Since there is independent control of each LED string, the PWM'd current of each string can be different, which may result in the total current load varying widely as shown. The different currents conducted by the respective strings results in the voltage drop across each string also being different, which can make it difficult for the boost converter output voltage to provide proper headroom control for the LED strings.

SUMMARY OF THE INVENTION

A multi-string LED driving method and system are presented which overcome the problems noted above, in that independent control of the LED strings is provided while a relatively constant load is imposed on the drive circuit.

The present method and system requires generating PWM'd driving signals to drive respective LED strings to control their respective brightness levels, and staggering the timing of the PWM'd driving signals such that the number of LED strings driven on simultaneously varies over time by no more than one LED string. The PWM'd driving signals are generated to, for example, achieve local dimming for a display device which employs a multi-string LED backlight system; the present method enables local dimming to be achieved while maintaining a relatively constant load on the drive circuit.

Each PWM'd driving signal toggles from a first state to a second state when its LED string is to be turned on. The staggering of the timing of the PWM'd driving signals is preferably implemented by arranging the ON times of the respective driving signals such that they occur serially. The LED strings are typically driven during periodic switching cycles of fixed-duration, with the pulse-width modulation and the staggering of the driving signals occurring during each of the periodic switching cycles. Staggering the driving signals in this way has the effect of spreading the load (and on-time of each LED string) throughout each switching cycle.

These and other features, aspects, and advantages of the present invention will become better understood with reference to the following drawings, description, and claims.

BRIEF DESCRIPTION OF THE DRAWINGS

FIG. 1 is a block/schematic diagram of a known multi-string LED driving system.

FIG. 2 is a timing diagram for the multi-string LED driving system shown in FIG. 1.

FIG. 3 is another possible timing diagram for the multi-string LED driving system shown in FIG. 1.

FIG. 5 is a block/schematic diagram of a multi-string LED driving system in accordance with the present invention.

DETAILED DESCRIPTION OF THE INVENTION

The present multi-string LED driving method is applicable to systems that pulse-width-modulate the currents conducted by multiple strings of LEDs in order to control their brightness. As before, the method requires generating PWM'd driving signals to drive respective LED strings to control their respective brightness levels. However, here, the timing of the PWM'd driving signals is staggered such that the number of LED strings driven ON simultaneously varies over time by no more than one LED string. In this way, the load imposed by the LED strings is maintained relatively constant. The present method is well-suited for use as a means of achieving 'local dimming' for a display device which employs a multi-string LED backlight system.

Figure 4:
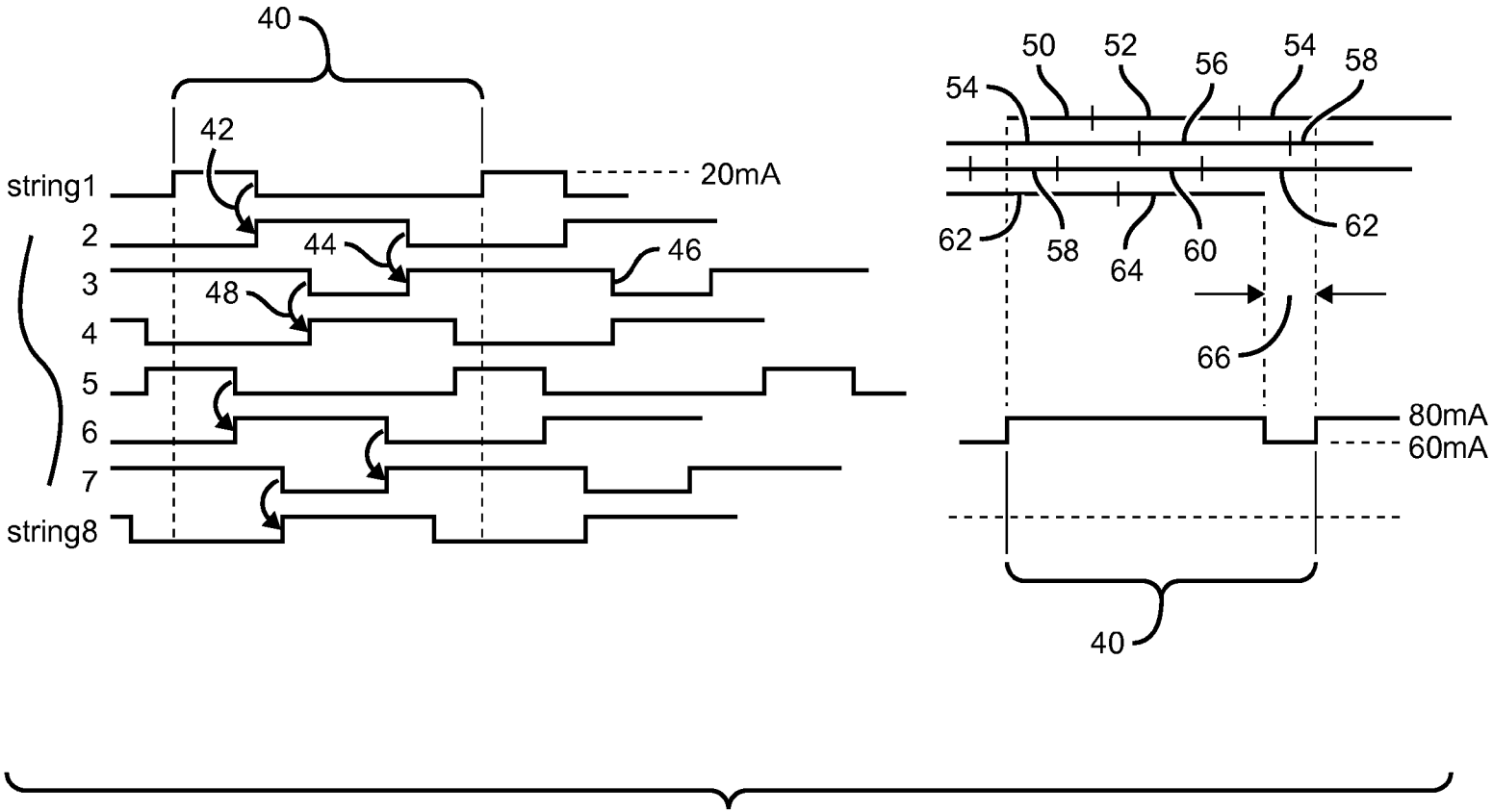
FIG. 4 is a timing diagram for a multi-string LED driving method in accordance with the present invention.

The staggering of the timing of the PWM'd driving signals preferably comprises arranging the ON times of the driving signals such that they occur serially. A timing diagram illustrating the operation of the present driving method as it might be used with 8 LED strings is shown in FIG. 4; the PWM driving signals delivered to the 8 LED strings are shown on the left, and the resulting current load is shown on the right. LED strings are typically driven during periodic switching cycles of fixed-duration; one such switching cycle 40 is shown in FIG. 4. The method is arranged such that the pulse-width-modulation and the serial staggering of the driving signals occurs during each of the periodic switching cycles.

Note that in the example that follows, the LED strings can be identified in any desired order. Also note that, in this example, an LED string is turned on and conducts current when its driving signal goes high; however, a low-going signal might be used in other systems to turn a string on. The duration of the high-going pulse is determined by the pulse-width-modulation needed to obtain the desired brightness from the LED string; the durations of these pulses are determined by well-known means that are outside the scope of this discussion.

Thus, a switching cycle begins with the driving signal to an LED string identified as 'string 1' going high for the required duration. When the string 1 driving signal goes low (42), the ON time for the driving signal for 'string 2' begins, and when that driving signal falls (44), the ON time for the driving signal for 'string 3' begins.

When the ON time for a particular driving signal ends after the switching cycle has completed, the ON time for the next driving signal will commence on the corresponding falling edge of that particular driving signal which occurs within the switching cycle. For example, In FIG. 4, the ON time for string 3 ends (46) outside of switching cycle 40. However, string 3 has a corresponding falling edge (48) which occurs within switching cycle 40. When falling edge 48 occurs, the ON time for string 4 can then commence. This pattern is continued for the remaining strings, such that the beginning of the ON time for each of the PWM signals effectively follows the end of the ON time of one of the other strings, with each of the ON times commencing within switching cycle 40.

When so arranged, the maximum load transient is reduced to the current of just one LED string. This is illustrated on the right side of FIG. 4. During switching cycle 40, string 1 is ON for a period 50, followed immediately by string 2 for an ON period 52, with the ON period 54 for string 3 beginning immediately thereafter; since these ON times occur serially, they represent a load equal to that of one LED string, which is imposed for the duration of switching cycle 40. Similarly, the end of ON period 54 for string 3, followed by the ON period 56 for string 4, and the start of the ON period 58 for string 5, also represent one load for the duration of switching cycle 40, as do the end of string 5's ON period 58, the ON period 60 for string 6, and the start of the ON period 62 for string 7. Finally, the end of string 7's ON period 62 and the ON period 64 of string 8 represent one load, but one which terminates prior to the end of switching cycle 40 such that there is a gap 66 during which this load is not imposed. Thus, for all but the gap 66 period, there are effectively four loads imposed on the driving circuits; if each LED string consumes 20 ma when on, then there is a relatively constant load of 80 ma during this time. During gap 66, there are three loads imposed, for a total load of 60 ma. As noted above, the maximum load transient has been reduced to the current (20 ma) of just one LED string; this will be the case regardless of the number of LED strings that an application uses.

Making the loading relatively constant in this way can improve the performance characteristics of the display. As noted above, the LED strings are typically powered by a switching power converter such as a boost converter. Forcing the boost converter to handle a widely fluctuating load may limit the time available for the converter to build up the energy needed to maintain a desired supply voltage. This can in turn limit the minimum duty cycle—and thus the maximum brightness range—over with which an LED string can be driven. For example, assume a conventional system with a boost converter driving 6 LED strings, each of which conducts 20 ma when on, with each string driven ON simultaneously for 3 μs. In this case, the converter must be able to accommodate a 120 ma load during the 3 μs ON time. This can be made even more difficult if the converter is arranged to stop switching when all of the LED strings are off and there is no load.

But using the present method, the ON times for each of the 6 LED strings occur serially, such that the converter only needs to accommodate a 20 ma load over a period of (6×3 μs=)18 μs. As a result of spreading out the load in this way, the LED strings can be driven with a lower duty cycle than is possible with the conventional method, thereby enabling a lower minimum brightness level and a wider brightness control range.

One possible embodiment of a system arranged to implement the present multi-string LED driving method is shown in FIG. 5. An LED drive circuit 70 interfaces with a number of LED strings 72, 74, 76, each of which includes multiple LEDs connected in series. Drive circuit 70 also controls a number of switching elements 80 which are connected to the cathode ends of respective strings, and provides a driving voltage V+ which is applied to the anode ends of each string. In this example, a timing circuit 82 within LED drive circuit 70 provides control signals to operate switching elements 80 independently, such that the currents conducted by the LED strings can be pulse-width modulated in accordance with the present method; the desired brightness levels may be conveyed to PWM timing circuit 82 by, for example, a high level controller (not shown). The DC voltage provided to the LED strings may be provided by, for example, a switching power converter (not shown)—most typically a boost converter.

Switching elements 80 may be implemented in any of a number of ways. One possibility is to implement the switching elements with regulated current sources or sinks, which get turned on and off by timing circuit 82. In this way, the current conducted by each LED string when ON can be established at a desired level. The current sources may be integrated together with the switching converter, or may be provided as one or more separate integrated circuits.

One possible method of implementing the timing aspect of the present method is now described. As noted above, LED strings are typically driven during periodic switching cycles of fixed-duration. In accordance with this exemplary method, the duration of each of the fixed-duration periodic switching cycles is evenly divided into a total of T+1 steps, identified as 'time 0 ' through 'time T'. The number of divisions determines the resolution of the method; for example, 8 bits of resolution are obtained if each switching cycle is divided into 256 steps, labeled 'time 0 ' to 'time 255'. The driving signals are then staggered such that:

for an LED string identified as the 'first' string having an ON time equal to N1 steps, the first string's ON time begins at time 0 and ends at time N1;

for an LED string identified as the 'second' string having an ON time equal to N2 steps, the second string's ON time begins at time N1 and ends at time V=N1+N2 if N1+N2<T and ends at time V=N1+N2−T if N1+N2≥T;

for an LED string identified as the 'third' string having an ON time equal to N3 steps, the third string's ON time begins at time V and ends at time W=N1+N2+N3 if N1+N2+N3<T and ends at time V=N1+N2+N3−T if N1 +N2+N3≥T;

and so forth, such that the ON times of the PWM'd driving signals occur serially within each of the fixed-duration periodic switching cycles. Note that the LED strings may be ordered in any desired way—i.e., any of the strings could be identified as the 'first' string, or the 'second' string, etc.

Figure 6:
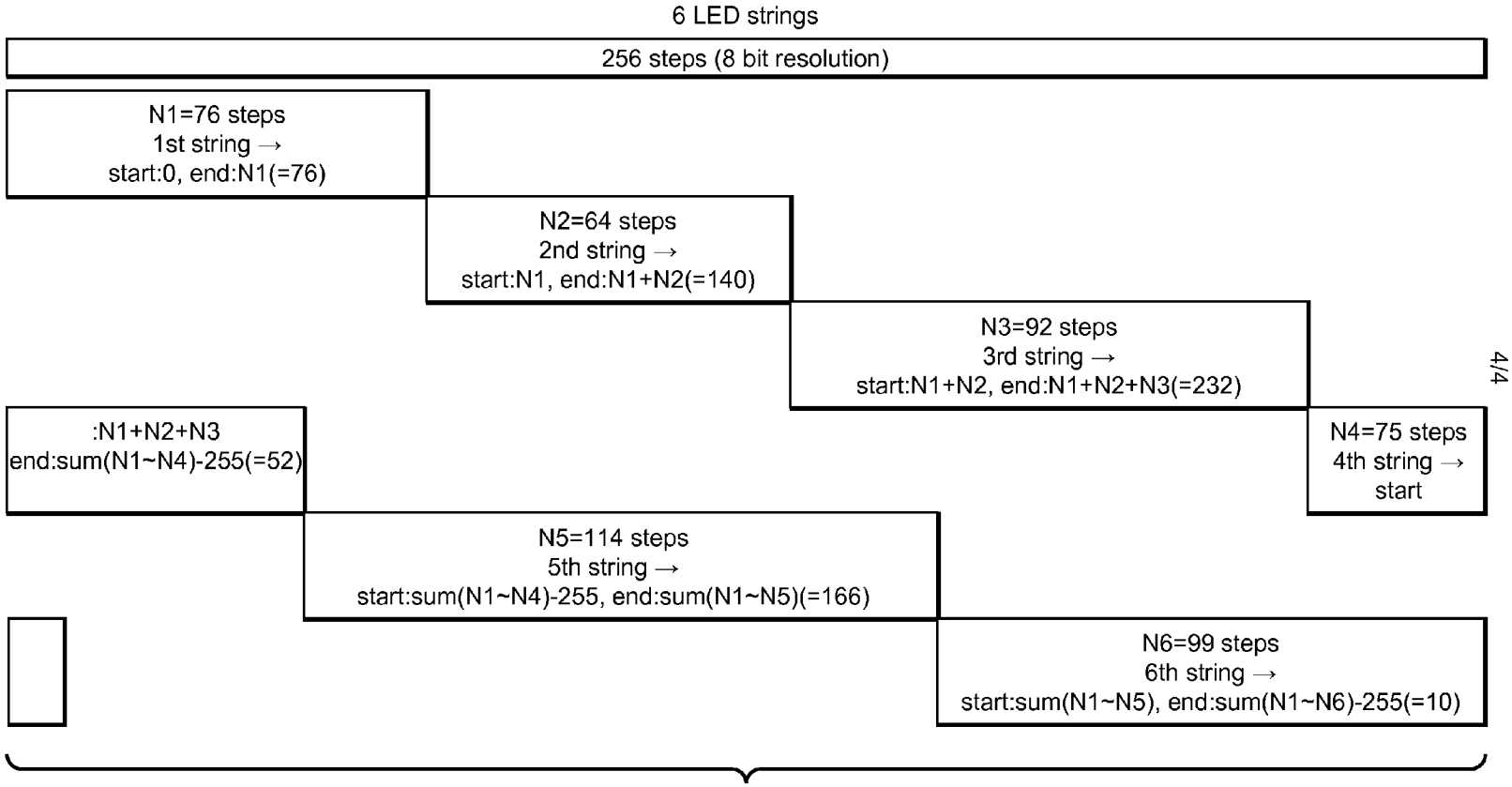
FIG. 6 is a diagram which further illustrates the operation of the present multi-string LED driving method.

A specific example of this approach is shown in FIG. 6, which is for a system with 6 LED strings and a switching cycle divided into 256 steps (time 0 to time 255). The timing circuit determines that the ON time for the first string should have a duration N1 of 76 steps. Thus, the first string's ON time starts at time 0 and ends at time 76, since 76<255. The duration N2 of the ON time for the second string is determined to be 64 steps. Thus, the second string starts at time N1=76 and ends at time N1+N2=76+64=140, since 140<255. The duration N3 of the ON time for the third string is determined to be 92 steps. Thus, the third string starts at time N1+N2=140 and ends at time N1 +N2+N3 =76+64+92 =232, since 232 <255.

The duration N4 of the ON time for the fourth string is determined to be 75 steps. Thus, the fourth string starts at time N1+N2+N3=232. However, because N1+N2+N3+N4=307, and 307≥255, the end of the ON time for the fourth string will be given by N1+N2+N3+N4−T=307-255=52. In this way, the ON time for the fourth string occurs serially after the conclusion of the ON time for the third string, but still within the same switching cycle.

The duration N5 of the ON time for the fifth string is determined to be 114 steps. Thus, the fifth string starts at time N1+N2+N3+N4−T=52 and ends at time N1+N2+N3+N4−T+N5=166, since 166<255.

The duration N6 of the ON time for the sixth string is determined to be 99 steps. Thus, the sixth string starts at time N1+N2+N3+N4−T+N5=166. However, because N1+N2+N3+N4−T+N5+N6=265, and 265≥255, the end of the ON time for the sixth string will be given by N1+N2+N3+N4−T+N5+N6−T=265-255=10. In this way, the ON time for the sixth string occurs serially after the conclusion of the ON time for the fifth string, but still within the same switching cycle.

The example shown in FIG. 6 is merely exemplary—there are numerous ways in which the staggered timing of the present method could be implemented. It is only essential that the timing be handled such that the PWM'd driving signals are staggered such that the number of LED strings driven ON simultaneously varies over time by no more than one LED string.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A multi-string LED driving method, comprising:

generating pulse-width-modulated (PWM'd) driving signals to drive respective LED strings to control their respective brightness levels; and staggering the timing of said PWM'd driving signals such that the number of LED strings driven ON simultaneously varies over time by no more than one LED string, wherein ON times of different PWM'd driving signals are independently adjustable to drive LED strings ON non-sequentially.

2. The method of claim 1, wherein said PWM'd driving signals are generated to achieve local dimming for a display device which employs a multi-string LED backlight system.

3. The method of claim 1, wherein said staggering of the timing of said PWM'd driving signals comprises arranging the ON times of said PWM'd driving signals such that they occur serially.

4. The method of claim 1, wherein said LED strings are driven during periodic switching cycles of fixed-duration, said pulse-width-modulation and said staggering of said LED string driving signals occurring during each of said periodic switching cycles.

5. The method of claim 4, wherein the duration of said each of said fixed-duration periodic switching cycles is evenly divided into a total of T+1 steps, said steps identified as 'time 0' through 'time T';

said staggering of said driving signals arranged such that:

for an LED string identified as the 'first' string having an ON time equal to N1 steps, said ON time begins at time 0 and ends at time N1;

for an LED string identified as the 'second' string having an ON time equal to N2 steps, said ON time begins at time N1 and ends at time V=N1+N2 if N1+N2<T and ends at time V=N1+N2−T if N1+N2≥T;

for an LED string identified as the 'third' string having an ON time equal to N3 steps, said ON time begins at time V and ends at time W=N1+N2+N3 if N1+N2+N3<T and ends at time W=N1+N2+N3−T if N1+N2+N>T;

and so forth, such that the ON times of said PWM'd driving signals occur serially within each of said fixed-duration periodic switching cycles.

6. A multi-string LED driving system, comprising:

a driving circuit arranged to generate pulse-width-modulated (PWM'd) driving signals which, when coupled to respective LED strings, drive said LED strings to respective brightness levels;

said driving circuit including a timing circuit arranged to stagger the timing of said PWM'd driving signals such that the number of LED strings driven ON simultaneously varies over time by no more than one LED string and arranged to provide independent adjustment of ON times of different PWM'd driving signals to drive LED strings ON non-sequentially.

7. The system of claim 6, wherein said PWM'd driving signals are generated to achieve local dimming for a display device which employs a multi-string LED backlight system.

8. The system of claim 6, wherein said timing circuit is arranged to stagger the timing of said PWM'd driving signals such that the ON times of said PWM'd driving signals occur serially.

9. The system of claim 6, wherein said LED strings are driven during periodic switching cycles of fixed-duration, wherein an ON time of a first PWM'd driving signal for an LED string follows a deactivating edge of an ON time of a specified different PWM'd driving signal of a different LED string, wherein, when the ON time for the specified different PWM'd driving signal ends after a switching cycle of fixed duration ends, the ON time for the first PWM'd driving signal begins on a corresponding deactivating edge of the specified different PWM'd signal that occurs during said switching cycle of fixed duration.

10. The system of claim 6, wherein said driving circuit is arranged such that said LED strings are driven during periodic switching cycles of fixed-duration, said timing circuit further arranged such that said pulse-width-modulation and said staggering of said LED string driving signals occurs during each of said periodic switching cycles.

11. The system of claim 10, wherein said driving circuit is arranged such that the duration of said each of said fixed-duration periodic switching cycles is evenly divided into a total of T+1 steps, said steps identified as 'time 0' through 'time T';

said timing circuit arranged such that:

for an LED string identified as the 'first' string having an ON time equal to N1 steps, said ON time begins at time 0 and ends at time N1;

for an LED string identified as the 'second' string having an ON time equal to N2 steps, said ON time begins at time N1 and ends at time V=N1+N2 if N1+N2<T and ends at time V=N1+N2−T if N1+N2≥T;

for an LED string identified as the 'third' string having an ON time equal to N3 steps, said ON time begins at time V and ends at time W=N1+N2+N3 if N1+N2+N3<T and ends at time W=N1+N2+N3−T if N1+N2+N3≥T;

and so forth, such that the ON times of said PWM'd driving signals occur serially within each of said fixed-duration periodic switching cycles.

* * * * *